US007807914B2

(12) United States Patent
Kamath et al.

(10) Patent No.: US 7,807,914 B2
(45) Date of Patent: Oct. 5, 2010

(54) WAVEFORM FETCH UNIT FOR PROCESSING AUDIO FILES

(75) Inventors: Nidish Ramachandra Kamath, Placentia, CA (US); Prajakt V Kulkarni, San Diego, CA (US); Samir Kumar Gupta, San Diego, CA (US); Stephen Molloy, Carlsbad, CA (US); Suresh Devalapalli, San Diego, CA (US); Allister Alemania, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 252 days.

(21) Appl. No.: 12/041,834

(22) Filed: Mar. 4, 2008

(65) Prior Publication Data

US 2008/0229911 A1 Sep. 25, 2008

Related U.S. Application Data

(60) Provisional application No. 60/896,414, filed on Mar. 22, 2007.

(51) Int. Cl.
*G10H 7/00* (2006.01)

(52) U.S. Cl. ..... 84/603; 84/602; 84/604; 84/615; 84/653

(58) Field of Classification Search ..... None
See application file for complete search history.

(56) References Cited

U.S. PATENT DOCUMENTS

| | | | | |
|---|---|---|---|---|
| 5,809,342 | A | 9/1998 | Gulick | |
| 5,918,302 | A * | 6/1999 | Rinn | 84/604 |
| 5,977,469 | A * | 11/1999 | Smith et al. | 84/627 |
| 6,858,790 | B2 | 2/2005 | Rossum | |

FOREIGN PATENT DOCUMENTS

| | | |
|---|---|---|
| EP | 1087372 | 3/2001 |
| EP | 1580729 | 9/2005 |

OTHER PUBLICATIONS

Partial International Search Report—PCT/US08/057221—International Search Authority, European Patent Office—Sep. 25, 2008.

* cited by examiner

*Primary Examiner*—Marlon T Fletcher
(74) *Attorney, Agent, or Firm*—Espartaco Diaz Hidalgo

(57) ABSTRACT

This disclosure describes techniques that make use of a waveform fetch unit that operates to retrieve waveform samples on behalf of each of a plurality of hardware processing elements that operate simultaneously to service various audio synthesis parameters generated from one or more audio files, such as musical instrument digital interface (MIDI) files. In one example, a method comprises receiving a request for a waveform sample from an audio processing element, and servicing the request by calculating a waveform sample number for the requested waveform sample based on a phase increment contained in the request and an audio synthesis parameter control word associated with the requested waveform sample, retrieving the waveform sample from a local cache using the waveform sample number, and sending the retrieved waveform sample to the requesting audio processing element.

50 Claims, 5 Drawing Sheets

WAVEFORM FETCH UNIT FOR PROCESSING AUDIO FILES

RELATED APPLICATIONS

Claim of Priority Under 35 U.S.C. §119

The present application for patent claims priority to Provisional Application No. 60/896,414 entitled "WAVEFORM FETCH UNIT FOR PROCESSING AUDIO FILES" filed Mar. 22, 2007, and assigned to the assignee hereof and hereby expressly incorporated by reference herein.

TECHNICAL FIELD

This disclosure relates to audio devices and, more particularly, to audio devices that generate audio output based on audio formats such as musical instrument digital interface (MIDI).

BACKGROUND

Musical Instrument Digital Interface (MIDI) is a format used in the creation, communication and/or playback of audio sounds, such as music, speech, tones, alerts, and the like. A device that supports the MIDI format playback may store sets of audio information that can be used to create various "voices." Each voice may correspond to one or more sounds, such as a musical note by a particular instrument. For example, a first voice may correspond to a middle C as played by a piano, a second voice may correspond to a middle C as played by a trombone, a third voice may correspond to a D# as played by a trombone, and so on. In order to replicate the musical note as played by a particular instrument, a MIDI compliant device may include a set of information for voices that specify various audio characteristics, such as the behavior of a low-frequency oscillator, effects such as vibrato, and a number of other audio characteristics that can affect the perception of sound. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be coded in accordance with the MIDI format by specifying events that indicate when certain voices should start and stop. In this way, the musical composition may be stored and transmitted in a compact file format according to the MIDI format.

MIDI is supported in a wide variety of devices. For example, wireless communication devices, such as radiotelephones, may support MIDI files for downloadable sounds such as ringtones or other audio output. Digital music players, such as the "iPod" devices sold by Apple Computer, Inc and the "Zune" devices sold by Microsoft Corporation may also support MIDI file formats. Other devices that support the MIDI format may include various music synthesizers, wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, video game consoles, various computerized toys for children, on-board computers used in automobiles, watercraft and aircraft, and a wide variety of other devices.

SUMMARY

In general, this disclosure describes techniques for processing audio files. The techniques may be particularly useful for playback of audio files that comply with the musical instrument digital interface (MIDI) format, although the techniques may be useful with other audio formats, techniques or standards. As used herein, the term MIDI file refers to any file that contains at least one audio track that conforms to a MIDI format. According to this disclosure, techniques make use of a waveform fetch unit that operates to retrieve waveform samples on behalf of each of a plurality of hardware processing elements that operate simultaneously to service various audio synthesis parameters generated from one or more audio files, such as MIDI files.

In one aspect, this disclosure provides a method comprising receiving a request for a waveform sample from an audio processing element, and servicing the request by calculating a waveform sample number for the requested waveform sample based on a phase increment contained in the request and an audio synthesis parameter control word associated with the requested waveform sample, retrieving the waveform sample from a local cache using the waveform sample number, and sending the retrieved waveform sample to the requesting audio processing element.

In another aspect, this disclosure provides a device comprising an audio processing element interface that receives a request for a waveform sample from an audio processing element, a synthesis parameter interface that obtains an audio synthesis parameter control word associated with the requested waveform sample, a local cache for storing the requested waveform sample. The device further comprises a fetch unit that calculates a waveform sample number for the requested waveform sample based on a phase increment contained in the request and the audio synthesis parameter control word, and retrieves the waveform sample from the local cache using the waveform sample number. The audio processing element interface sends the retrieved waveform sample to the requesting audio processing element.

In another aspect, this disclosure provides a device comprising means for receiving a request for a waveform sample from an audio processing element, means for obtaining an audio synthesis parameter control word associated with the requested waveform sample, and means for storing the requested waveform sample. The device further comprises means for calculating a waveform sample number for the requested waveform sample based on a phase increment contained in the request and the audio synthesis parameter control word, means for retrieving the waveform sample from the local cache using the waveform sample number, and means for sending the retrieved waveform sample to the requesting audio processing element.

In another aspect, this disclosure provides a computer-readable medium comprising instructions that upon execution in one or more processors cause the one or more processors to receive a request for a waveform sample from an audio processing element, and service the request. Servicing the request may include calculating a waveform sample number for the requested waveform sample based on a phase increment contained in the request and an audio synthesis parameter control word associated with the requested waveform sample, retrieving the waveform sample from a local cache using the waveform sample number, and sending the retrieved waveform sample to the requesting audio processing element.

In another aspect, this disclosure provides a circuit adapted to receive a request for a waveform sample from an audio processing element, and service the request, wherein servicing the request includes calculating a waveform sample number for the requested waveform sample based on a phase increment contained in the request and an audio synthesis parameter control word associated with the requested waveform sample retrieving the waveform sample from a local cache using the waveform sample number, and sending the retrieved waveform sample to the requesting audio processing element.

The details of one or more aspects of this disclosure are set forth in the accompanying drawings and the description below. Other features, objects, and advantages of the invention will be apparent from the description and drawings, and from the claims.

DETAILED DESCRIPTION

This disclosure describes techniques for processing audio files. The techniques may be particularly useful for playback of audio files that comply with the musical instrument digital interface (MIDI) format, although the techniques may be useful with other audio formats, techniques or standards that make use of synthesis parameters. As used herein, the term MIDI file refers to any audio data or file that contains at least one audio track that conforms to the MIDI format. Examples of various file formats that may include MIDI tracks include CMX, SMAF, XMF, SP-MIDI, to name a few. CMX stands for Compact Media Extensions, developed by Qualcomm Inc. SMAF stands for the Synthetic Music Mobile Application Format, developed by Yamaha Corp. XMF stands for eXtensible Music Format, and SP-MIDI stands for Scalable Polyphony MIDI.

MIDI files or other audio files can be conveyed between devices within audio frames, which may include audio information or audio-video (multimedia) information. An audio frame may comprise a single audio file, multiple audio files, or possibly one or more audio files and other information such as coded video frames. Any audio data within an audio frame may be termed an audio file, as used herein, including streaming audio data or one or more audio file formats listed above. According to this disclosure, techniques make use of a waveform fetch unit (WFU) that retrieves waveform samples on behalf of each of a plurality of processing elements (e.g., within a dedicated MIDI hardware unit).

The described techniques may improve processing of audio files, such as MIDI files. The techniques may separate different tasks into software, firmware, and hardware. A general purpose processor may execute software to parse audio files of an audio frame and thereby identify timing parameters, and to schedule events associated with the audio files. The scheduled events can then be serviced by a DSP in a synchronized manner, as specified by timing parameters in the audio files. The general purpose processor dispatches the events to the DSP in a time-synchronized manner, and the DSP processes the events according to the time-synchronized schedule in order to generate synthesis parameters. The DSP then schedules processing of the synthesis parameters by processing elements of a hardware unit, and the hardware unit can generate audio samples based on the synthesis parameters using processing elements, the WFU and other components.

According to this disclosure, the exact waveform sample retrieved by the WFU in response to a request by a processing element depends on a phase increment, supplied by the processing element, as well as the current phase. The WFU checks whether the waveform sample is cached, retrieves the waveform sample, and may perform data formatting before returning the waveform sample to the requesting processing element. Waveform samples are stored in external memory, and the WFU employs a caching strategy to alleviate bus congestion.

Figure 1:
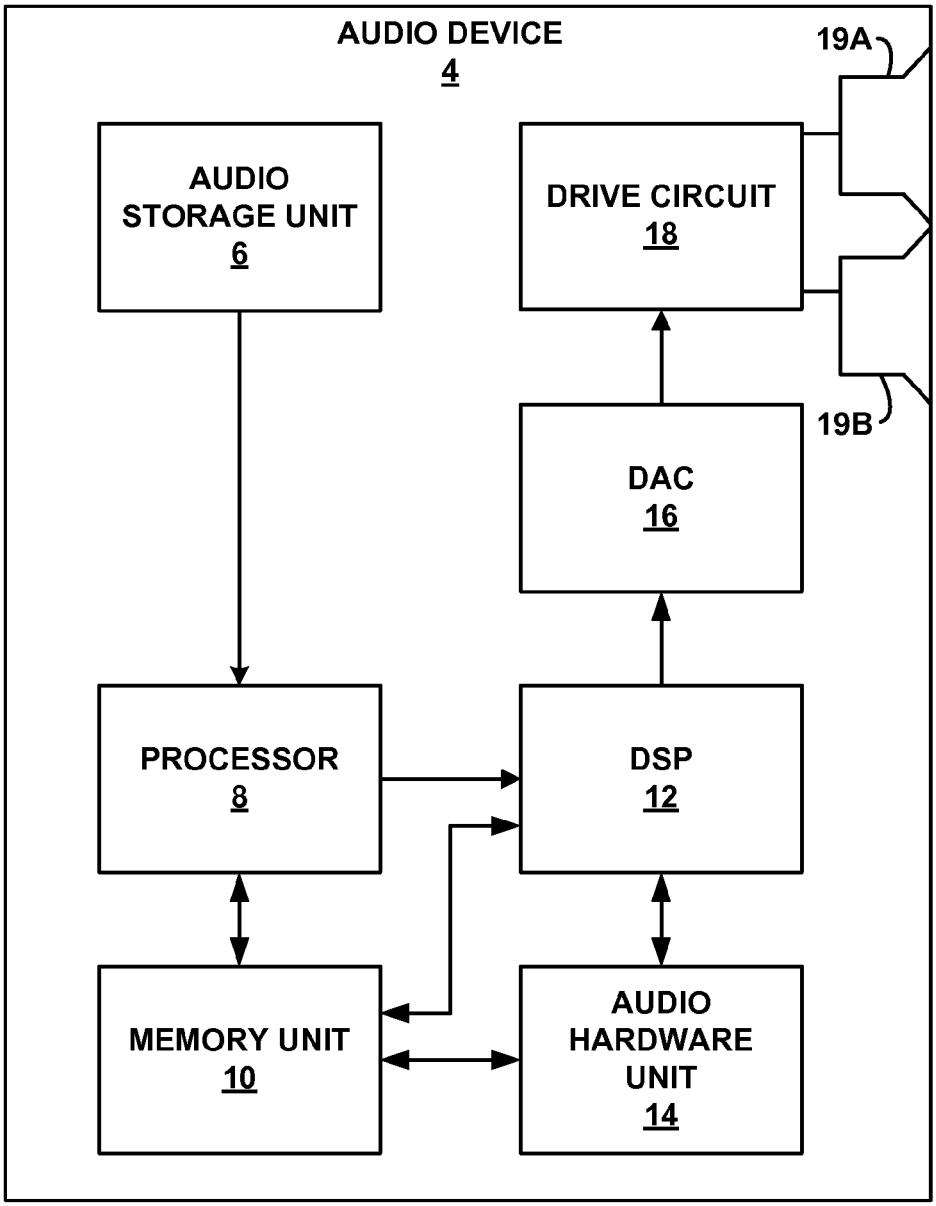
FIG. 1 is a block diagram illustrating an exemplary audio device that may implement the techniques for processing audio files in accordance with this disclosure.

FIG. 1 is a block diagram illustrating an exemplary audio device 4. Audio device 4 may comprise any device capable of processing MIDI files, e.g., files that include at least one MIDI track. Examples of audio device 4 include a wireless communication device such as a radiotelephone, a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, a circuit board installed in a device, a kiosk device, a video game console, various computerized toys for children, a video game console, an on-board computer used in an automobile, watercraft or aircraft, or a wide variety of other devices.

The various components illustrated in FIG. 1 are provided to explain aspects of this disclosure. However, other components may exist and some of the illustrated components may not be included in some implementations. For example, if audio device 4 is a radiotelephone, then an antenna, transmitter, receiver and modem (modulator-demodulator) may be included to facilitate wireless communication of audio files.

As illustrated in the example of FIG. 1, audio device 4 includes an audio storage unit 6 to store MIDI files. Again, MIDI files generally refer to any audio file that includes at least one track coded in a MIDI format. Audio storage unit 6 may comprise any volatile or non-volatile memory or storage. For purposes of this disclosure, audio storage unit 6 can be viewed as a storage unit that forwards MIDI files to processor 8, or processor 8 retrieves MIDI files from audio storage unit 6, in order for the files to be processed. Of course, audio storage unit 6 could also be a storage unit associated with a digital music player or a temporary storage unit associated with information transfer from another device. Audio storage unit 6 may be a separate volatile memory chip or non-volatile storage device coupled to processor 8 via a data bus or other connection. A memory or storage device controller (not shown) may be included to facilitate the transfer of information from audio storage unit 6.

In accordance with this disclosure, device 4 implements an architecture that separates MIDI processing tasks between software, hardware and firmware. In particular, device 4 includes a processor 8, a DSP 12 and an audio hardware unit 14. Each of these components may be coupled to a memory unit 10, e.g., directly or via a bus. Processor 8 may comprise a general purpose processor that executes software to parse MIDI files and schedule MIDI events associated with the MIDI files. The scheduled events can be dispatched to DSP 12 in a time-synchronized manner and thereby serviced by DSP 12 in a synchronized manner, as specified by timing parameters in the MIDI files. DSP 12 processes the MIDI events according to the time-synchronized schedule created by general purpose processor 8 in order to generate MIDI synthesis parameters. DSP 12 may also schedule subsequent processing of the MIDI synthesis parameters by audio hardware unit 14. Audio hardware unit 14 generates audio samples based on the synthesis parameters.

Processor 8 may comprise any of a wide variety of general purpose single- or multi-chip microprocessors. Processor 8 may implement a CISC (Complex instruction Set Computer) design or a RISC (Reduced Instruction Set Computer) design. Generally, processor 8 comprises a central processing unit (CPU) that executes software. Examples include 16-bit, 32-bit or 64-bit microprocessors from companies such as Intel Corporation, Apple Computer, Inc, Sun Microsystems Inc., Advanced Micro Devices (AMD) Inc., and the like. Other examples include Unix- or Linux-based microprocessors from companies such as International Business Machines (IBM) Corporation, RedHat Inc., and the like. The general purpose processor may comprise the ARM9, which is commercially available from ARM Inc., and the DSP may comprise the QDSP4 DSP developed by Qualcomm Inc.

Processor 8 may service MIDI files for a first frame (frame N), and when the first frame (frame N) is serviced by DSP 12, a second frame (frame N+1) can be simultaneously serviced by processor 8. When the first frame (frame N) is serviced by audio hardware unit 14, the second frame (frame N+1) is simultaneously serviced by DSP 12 while a third frame (frame N+2) is serviced by processor 8. In this way, MIDI file processing is separated into pipelined stages that can be processed at the same time, which can improve efficiency and possibly reduce the computational resources needed for given stages. DSP 12, for example, may be simplified relative to conventional DSPs that execute a full MIDI algorithm without the aid of a processor 8 or MIDI hardware 14.

In some cases, audio samples generated by MIDI hardware 14 are delivered back to DSP 12, e.g., via interrupt-driven techniques. In this case, DSP may also perform post-processing techniques on the audio samples. DAC 16 converts the audio samples, which are digital, into analog signals that can be used by drive circuit 18 to drive speakers 19A and 19B for output of audio sounds to a user.

For each audio frame, processor 8 reads one or more MIDI files and may extract MIDI instructions from the MIDI file. Based on these MIDI instructions, processor 8 schedules MIDI events for processing by DSP 12, and dispatches the MIDI events to DSP 12 according to this scheduling. In particular, this scheduling by processor 8 may include synchronization of timing associated with MIDI events, which can be identified based on timing parameters specified in the MIDI files. MIDI instructions in the MIDI files may instruct a particular MIDI voice to start or stop. Other MIDI instructions may relate to aftertouch effects, breath control effects, program changes, pitch bend effects, control messages such as pan left or right, sustain pedal effects, main volume control, system messages such as timing parameters, MIDI control messages such as lighting effect cues, and/or other sound affects. After scheduling MIDI events, processor 8 may provide the scheduling to memory 10 or DSP 12 so that DSP 12 can process the events. Alternatively, processor 8 may execute the scheduling by dispatching the MIDI events to DSP 12 in the time-synchronized manner.

Memory 10 may be structured such that processor 8, DSP 12 and MIDI hardware 14 can access any information needed to perform the various tasks delegated to these different components. In some cases, the storage layout of MIDI information in memory 10 may be arranged to allow for efficient access from the different components 8, 12 and 14.

When DSP 12 receives scheduled MIDI events from processor 8 (or from memory 10), DSP 12 may process the MIDI events in order to generate MIDI synthesis parameters, which may be stored back in memory 10. Again, the timing in which these MIDI events are serviced by DSP is scheduled by processor 8, which creates efficiency by eliminating the need for DSP 12 to perform such scheduling tasks. Accordingly, DSP 12 can service the MIDI events for a first audio frame while processor 8 is scheduling MIDI events for the next audio frame. Audio frames may comprise blocks of time, e.g., 10 millisecond (ms) intervals, that may include several audio samples. The digital output, for example, may result in 480 samples per frame, which can be converted into an analog audio signal. Many events may correspond to one instance of time so that many notes or sounds can be included in one instance of time according to the MIDI format. Of course, the amount of time delegated to any audio frame, as well as the number of samples per frame may vary in different implementations.

Once DSP 12 has generated the MIDI synthesis parameters, audio hardware unit 14 generates audio samples based on the synthesis parameters. DSP 12 can schedule the processing of the MIDI synthesis parameters by audio hardware unit 14. The audio samples generated by audio hardware unit 14 may comprise pulse-code modulation (PCM) samples, which are digital representations of an analog signal that is sampled at regular intervals. Additional details of exemplary audio generation by audio hardware unit 14 are discussed below with reference to FIG. 2.

In some cases, post processing may need to be performed on the audio samples. In this case, audio hardware unit 14 can send an interrupt command to DSP 12 to instruct DSP 12 to perform such post processing. The post processing may include filtering, scaling, volume adjustment, or a wide variety of audio post processing that may ultimately enhance the sound output.

Following the post processing, DSP 12 may output the post processed audio samples to digital-to analog converter (DAC) 16. DAC 16 converts the digital audio signals into an analog signal and outputs the analog signal to a drive circuit 18. Drive circuit 18 may amplify the signal to drive one or more speakers 19A and 19B to create audible sound.

Figure 2:
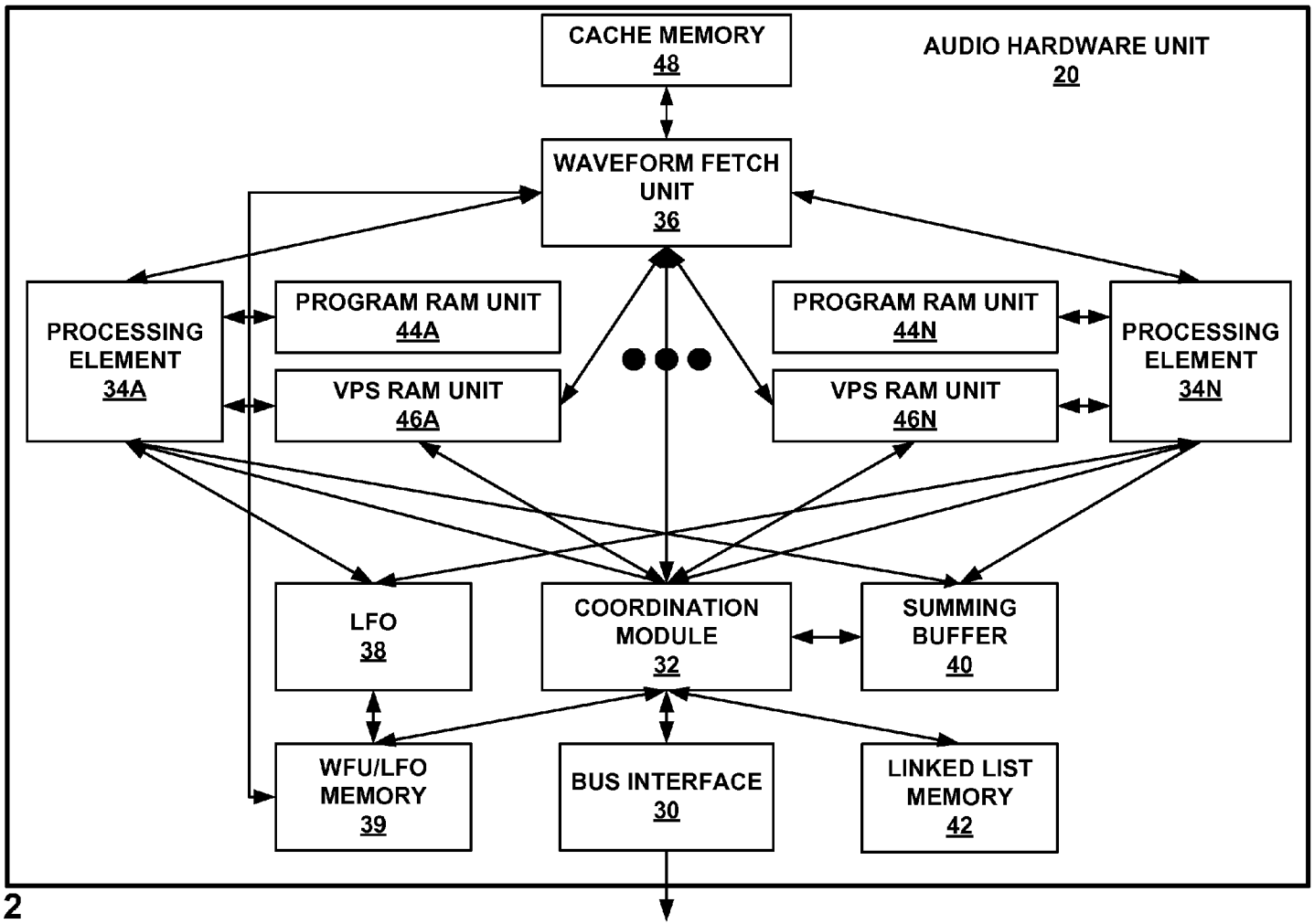
FIG. 2 is a block diagram of one example of a hardware unit for processing audio synthesis parameters according to this disclosure.

FIG. 2 is a block diagram illustrating an exemplary audio hardware unit 20, which may correspond to audio hardware unit 14 of audio device 4 of FIG. 1. The implementation shown in FIG. 2 is merely exemplary as other MIDI hardware implementations could also be defined consistent with the teaching of this disclosure. As illustrated in the example of FIG. 2, audio hardware unit 20 includes a bus interface 30 to send and receive data. For example, bus interface 30 may include an AMBA High-performance Bus (AHB) master interface, an AHB slave interface, and a memory bus interface. AMBA stands for advanced microprocessor bus architecture. Alternatively, bus interface 30 may include an AXI bus interface, or another type of bus interface. AXI stands for advanced extensible interface.

In addition, audio hardware unit 20 may include a coordination module 32. Coordination module 32 coordinates data flows within audio hardware unit 20. When audio hardware unit 20 receives an instruction from DSP 12 (FIG. 1) to begin synthesizing an audio sample, coordination module 32 reads the synthesis parameters for the audio frame, which were generated by DSP 12 (FIG. 1). These synthesis parameters can be used to reconstruct the audio frame. For the MIDI format, synthesis parameters describe various sonic characteristics of one or more MIDI voices within a given frame. For example, a set of MIDI synthesis parameters may specify a level of resonance, reverberation, volume, and/or other characteristics that can affect one or more voices.

At the direction of coordination module 32, synthesis parameters may be loaded directly from memory unit 10 (FIG. 1) into voice parameter set (VPS) RAM 46A or 46N associated with a respective processing element 34A or 34N. At the direction of DSP 12 (FIG. 1), program instructions are loaded from memory 10 into program RAM units 44A or 44N associated with a respective processing element 34A or 34N.

The instructions loaded into program RAM unit 44A or 44N instruct the associated processing element 34A or 34N to synthesize one of the voices indicated in the list of synthesis parameters in VPS RAM unit 46A or 46N. There may be any number of processing elements 34A-34N (collectively "processing elements 34"), and each may comprise one or more ALUs that are capable of performing mathematical operations, as well as one or more units for reading and writing data. Only two processing elements 34A and 34N are illustrated for simplicity, but many more may be included in hardware unit 20. Processing elements 34 may synthesize voices in parallel with one another. In particular, the plurality of different processing elements 34 work in parallel to process different synthesis parameters. In this manner, a plurality processing elements 34 within audio hardware unit 20 can accelerate and possibly increase the number of generated voices, thereby improving the generation of audio samples.

When coordination module 32 instructs one of processing elements 34 to synthesize a voice, the respective one of processing elements 34 may execute one or more instructions defined by the synthesis parameters. Again, these instructions may be loaded into program RAM unit 44A or 44N. The instructions loaded into program RAM unit 44A or 44N cause the respective one of processing elements 34 to perform voice synthesis. For example, processing elements 34 may send requests to a waveform fetch unit (WFU) 36 for a waveform specified in the synthesis parameters. Each of processing elements 34 may use WFU 36. Each of processing elements 34 may use WFU 36. WFU 36 uses an arbitration scheme to resolve any conflicts if two or more processing elements 34 request use of WFU 36 at the same time.

Based on the pitch increment, pitch envelope, and LFO to pitch parameter, processing element 34 computes the phase increment for a given sample for a given voice and sends the phase increment to WFU 36. WFU 36 computes the sample indexes in a waveform that are required for computing an interpolated value of the current output sample. WFU 36 also computes the fractional phase required for the interpolation and sends it to the requesting processing element 34. WFU 36 is designed to employ a caching strategy to minimize accesses to memory unit 10 and thereby alleviate congestion of bus interface 30.

In response to a request from one of processing elements 34, WFU 36 returns one or more waveform samples to the requesting processing element. However, because a wave can be phase shifted within a sample, e.g., by up to one cycle of the wave, WFU 36 may return two samples in order to compensate for the phase shifting using interpolation. Furthermore, because a stereo signal may include two separate waves for the two stereophonic channels, WFU 36 may return separate samples for different channels, e.g., resulting in up to four separate samples for stereo output.

In one example implementation, the waveforms may be organized within memory unit 10 to enable WFU 36 to reuse a greater number of waveform samples before having to access memory unit 10. One base waveform sample is stored per octave, from which every other note within the octave may be interpolated. The base waveform sample for each octave is selected correspond to a note in the octave having one of the higher frequencies in the octave (in some cases the highest frequency). As a result, the amount of data that must be fetched to produce the other notes in the octave is reduced. This technique may result in the cached waveform sample being hit a greater number of times compared to the case where the sample note is placed in the lower frequency range of the octave, resulting in reduced bandwidth requirements on bus interface 30. Auditory tests may be applied in selecting an appropriate note, so as to ensure acceptable sound quality for the other notes in the octave that are produced from the base waveform sample stored in memory unit 10.

After WFU 36 returns audio samples to one of processing elements 34, the respective processing element (PE) may execute additional program instructions based on the audio synthesis parameters. In particular, instructions cause one of processing elements 34 to request an asymmetric triangular wave from a low frequency oscillator (LFO) 38 in audio hardware unit 20. By multiplying a waveform returned by WFU 36 with a triangular wave returned by LFO 38, the respective processing element may manipulate various sonic characteristics of the waveform to achieve a desired audio affect. For example, multiplying a waveform by a triangular wave may result in a waveform that sounds more like a desired musical instrument.

Other instructions executed based on the synthesis parameters may cause a respective one of processing elements 34 to loop the waveform a specific number of times, adjust the amplitude of the waveform, add reverberation, add a vibrato effect, or cause other effects. In this way, processing elements 34 can calculate a waveform for a voice that lasts one MIDI frame. Eventually, a respective processing element may encounter an exit instruction. When one of processing elements 34 encounters an exit instruction, that processing element signals the end of voice synthesis to coordination module 32. The calculated voice waveform can be provided to summing buffer 40 at the direction of another store instruction during the execution of the program instructions. This causes summing buffer 40 to store that calculated voice waveform.

When summing buffer 40 receives a calculated waveform from one of processing elements 34, summing buffer 40 adds the calculated waveform to the proper instance of time associated with an overall waveform for a MIDI frame. Thus, summing buffer 40 combines output of the plurality of processing elements 34. For example, summing buffer 40 may initially store a flat wave (i.e., a wave where all digital samples are zero.) When summing buffer 40 receives audio information such as a calculated waveform from one of processing elements 34, summing buffer 40 can add each digital sample of the calculated waveform to respective samples of the waveform stored in summing buffer 40. In this way, summing buffer 40 accumulates and stores an overall digital representation of a waveform for a full audio frame.

Summing buffer 40 essentially sums different audio information from different ones of processing elements 34. The different audio information is indicative of different instances of time associated with different generated voices. In this manner, summing buffer 40 creates audio samples representative of an overall audio compilation within a given audio frame.

Eventually, coordination module 32 may determine that processing elements 34 have completed synthesizing all of the voices required for the current MIDI frame and have provided those voices to summing buffer 40. At this point, summing buffer 40 contains digital samples indicative of a completed waveform for the current MIDI frame. When coordination module 32 makes this determination, coordination module 32 sends an interrupt to DSP 12 (FIG. 1). In response to the interrupt, DSP 12 may send a request to a control unit in summing buffer 40 (not shown) via direct memory exchange (DME) to receive the content of summing buffer 40. Alternatively, DSP 12 may also be pre-programmed to perform the DME. DSP 12 may then perform any post processing on the digital audio samples, before providing the digital audio samples to DAC 16 for conversion into the analog domain. Importantly, the processing performed by audio hardware unit 20 with respect to a frame N+2 occurs simultaneously with synthesis parameter generation by DSP 12 (FIG. 1) with respect to a frame N+1 and scheduling operations by processor 8 (FIG. 1) with respect to a frame N.

Cache memory 48, WFU/LFO memory 39 and linked list memory 42 are also shown in FIG. 2. Cache memory 48 may be used by WFU 36 to fetch base waveforms in a quick and efficient manner. WFU/LFO memory 39 may be used by coordination module 32 to store voice parameters of the voice parameter set. In this way, WFU/LFO memory 39 can be viewed as memories dedicated to the operation of waveform fetch unit 36 and LFO 38. Linked list memory 42 may comprise a memory used to store a list of voice indicators generated by DSP 12. The voice indicators may comprise pointers to one or more synthesis parameters stored in memory 10. Each voice indicator in the list may specify the memory location that stores a voice parameter set for a respective MIDI voice. The various memories and arrangements of memories shown in FIG. 2 are purely exemplary. The techniques described herein could be implemented with a variety of other memory arrangements.

Figure 3:
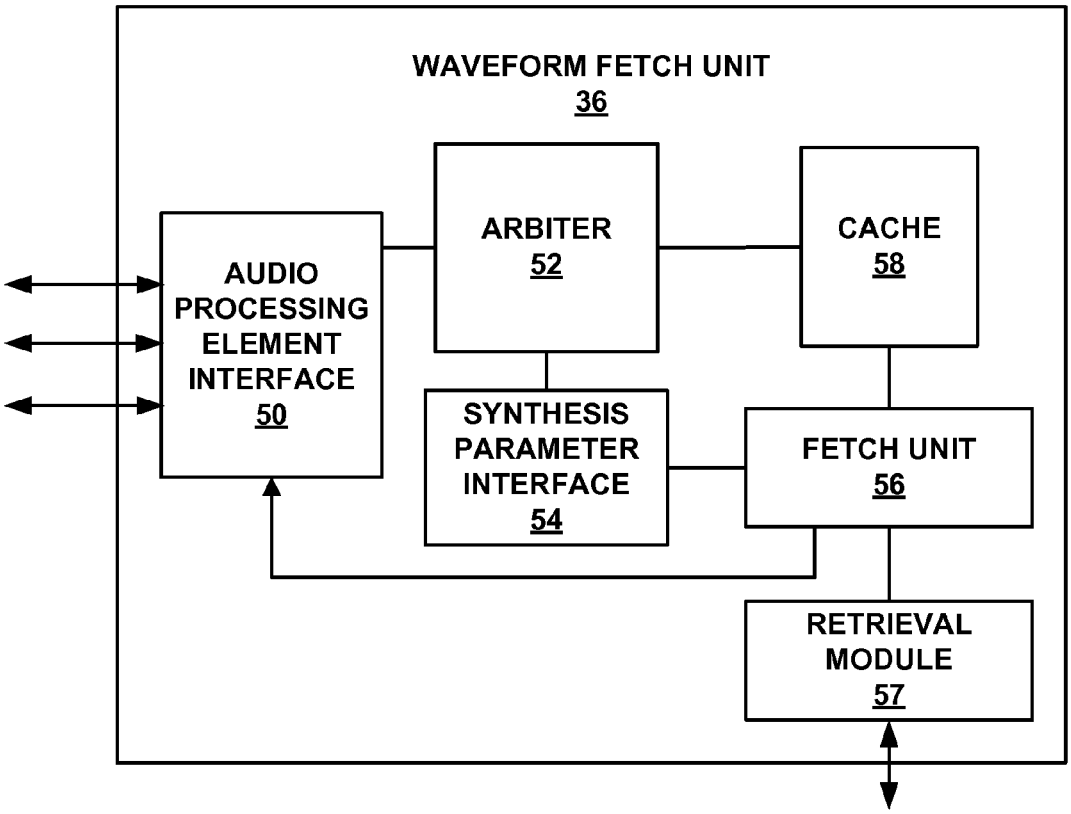
FIG. 3 is a block diagram illustrating an exemplary architecture of a waveform fetch unit according to this disclosure.

FIG. 3 is a block diagram of one example of WFU 36 of FIG. 2 according to this disclosure. As shown in FIG. 3, WFU 36 may include an arbiter 52, synthesis parameter interface 54, fetch unit 56, and cache 58. WFU 36 is designed to employ a caching strategy to minimize accesses to external memory and thereby alleviate bus congestion. As described in further detail below, arbiter 54 may employ a modified round-robin arbitration scheme to handle requests received from a plurality of audio processing elements 34.

WFU 36 receives a request for a waveform sample from one of audio processing elements 34. The request may indicate a phase increment to be added to the current phase to obtain a new phase value. The integer part of the new phase value is used for generating the physical address of the waveform sample to be fetched. The fractional part of the phase value is fed back to the audio processing element 34 to use for interpolation. Since certain audio processing, such as MIDI synthesis, heavily uses adjacent samples before jumping to the next one, caching of the waveform samples helps reduce the bandwidth requirement by audio hardware unit 20 on bus interface 30. WFU 36 also supports multiple audio pulse code modulation (PCM) formats, such as 8 bit mono, 8-bit stereo, 16-bit mono, or 16-bit stereo. WFU 36 may reformat waveform samples to a uniform PCM format before returning the waveform samples to audio processing elements 34. For example, WFU 36 may return waveform samples in 16-bit stereo format.

Synthesis parameter interface 54 is used to fetch the waveform-specific synthesis parameters from a synthesis parameter RAM, e.g., within WFU/LFO memory 39 (FIG. 2). Waveform-specific synthesis parameters may include, for example, loop begin and loop end indicators. As another example, the waveform-specific synthesis parameters may include a synthesis voice register (SVR) control word. The waveform-specific synthesis parameters affect how WFU 36 services the waveform sample requests. For example, WFU 36 uses the SVR control word for determining whether the waveform sample is looped or non-looped ("one-shot"), which in turn impacts how WFU 36 calculates a waveform sample number used in locating the waveform sample in cache 58 or external memory.

Synthesis parameter interface 54 retrieves the waveform-specific synthesis parameters from WFU/LFO memory 39, and WFU 36 may buffer the waveform-specific synthesis parameters locally to reduce activity on synthesis parameter interface 54. Before WFU 36 can service a request from one of audio processing elements 34, WFU 36 must have synthesis parameters corresponding to the waveform requested by audio processing element 34 locally buffered. Synthesis parameters only become invalid when the respective one of audio processing element 34 is given another voice to synthesize or synthesis parameter interface 54 is instructed by coordination module 32 to invalidate a synthesis parameter. As a result, WFU 36 does not need to reprogram the synthesis parameters when only the format of the requested waveform sample has changed from one request to the next (e.g., from mono to stereo, or from 8-bit to 16-bit). If WFU 36 does not have valid synthesis parameters buffered for the request of a respective audio processing element, arbiter 52 may bump that request to the lowest priority and fetch unit 56 may service another audio processing element 34 whose synthesis parameters are valid (i.e., the synthesis parameters corresponding to the requested waveform are buffered). WFU 36 may continue to bump a respective request of an audio processing element until synthesis parameter interface 54 has retrieved and locally buffered the corresponding synthesis parameters. In this manner, unnecessary stalls may be avoided, since WFU 36 need not wait for invalid synthesis parameters to become valid before moving on to a request, but instead can bump the request with invalid synthesis parameters and move on to service other requests whose synthesis parameters are valid.

Synthesis parameter interface 54 may invalidate (but not erase) the synthesis parameters for any audio processing element 34. If fetch unit 56 and synthesis parameter interface 54 are concurrently working on different audio processing elements 34, no issues arise. However, in the case that both synthesis parameter interface 54 and fetch unit 56 are working on the waveform-specific synthesis parameters for the same audio processing element 34 (i.e., fetch unit 56 is reading the synthesis parameter values while synthesis parameter interface 54 is attempting to overwrite them), fetch unit 56 will take precedence, causing the synthesis parameter interface 54 to block until the operations of fetch unit 56 are complete. Thus, a synthesis parameter invalidation request from synthesis parameter interface 54 will only take effect once the currently running fetch unit 56 operation, if any, for that audio processing element 34 has completed. Synthesis parameter interface 54 may enforce circular buffering of synthesis parameters.

WFU 36 may maintain separate cache space within cache 58 for each of audio processing elements 34. As a result, there are no context switches when WFU 36 switches from servicing one of audio processing elements 34 to another. Cache 58 may be sized as line size=16 bytes, sets=1, ways=1. Fetch unit 56 checks cache 58 to determine whether the required waveform sample is within cache 58. When a cache miss occurs, fetch unit 56 may calculate a physical address of the required data within the external memory based on a current pointer to a base waveform sample and a waveform sample number, and place an instruction to fetch the waveform sample from external memory into a queue. The instruction may include the calculated physical address. Retrieval module 57 checks the queue, and upon seeing an instruction in the queue to retrieve a cache line from external memory, retrieval module 57 initiates a burst request to replace the current cache line within cache 58 with data from external memory. When retrieval module 57 has retrieved the cache line from external memory, fetch unit 56 then completes the request. Retrieval module 57 may be responsible for retrieving burst data from external memory as well as handling write operations to cache 58. Retrieval module 57 may be a separate finite state machine from fetch unit 56. Thus, fetch unit 56 may be free to handle other requests from audio processing elements 34 while retrieval module 57 retrieves the cache line. As a result, requests resulting in both cache hits and cache misses may be serviced by WFU 36, as long as the synthesis parameters for the request are valid and the audio processing element interface 50 is not busy. Depending on the implementation, retrieval module 57 may retrieve the cache line from cache memory 48 (FIG. 2), or memory unit 10 (FIG. 1).

In other embodiments, arbiter 52 may allow fetch unit 56 to service the audio processing element requests based on how many of the waveform samples for the requests are already present within the cache. For example, arbiter 52 may bump a request to the lowest priority when the requested waveform sample is not currently present within cache 58, thereby servicing requests whose waveform samples are present in cache 58 sooner. To prevent an audio processing element 34 from being starved (i.e., its request never being serviced) if its requested waveform sample is not present within the cache, arbiter 52 may flag a bumped request as "skipped." When a skipped request comes up a second time, the skipped flag acts as an override to prevent arbiter 52 from bumping the request again, and the waveform may be retrieved from external memory. If desired, several flags of increasing priority could be used to allow multiple skips by arbiter 52.

Arbiter 52 is responsible for arbitrating incoming requests from audio processing elements 34. Fetch unit 56 performs the calculations required to determine which samples to return. Arbiter 52 employs a modified round-robin arbitration scheme. When reset, WFU 36 assigns each of the audio processing elements 34 a default priority, e.g., with audio processing element 34A being the highest and audio processing element 34N being the lowest. Requests are initially arbitrated using a standard round-robin arbiter. The winner of this initial arbitration, however, is not necessarily granted access to fetch unit 56. Instead, the request is checked for whether its SVR data is valid, and whether the corresponding audio processing element interface 50 is busy. These checks are combined to create a "win" condition. In some embodiments, additional checks may be required for a win condition. If a win condition occurs, the audio processing element's request is serviced. If a win condition does not occur for a particular request, arbiter 52 bumps the audio processing element's request down and moves on to similarly check the next audio processing element request. In the case where either the SVR data for a request is invalid or the audio processing element interface 50 is busy, the request may be bumped indefinitely since no calculations can be made for the request. Thus, the round-robin arbitration is referred to as "modified" since audio processing element requests may not be serviced if their synthesis parameters are invalid or their audio processing element interface is busy.

WFU 36 may also operate in a test mode, wherein WFU 36 enforces strict round-robin functionality. That is, arbiter 52 causes requests to be serviced in order from audio processing element 34A, audio processing element 34B, . . . , audio processing element 34N, back to audio processing element 34A, and so on. This differs in functionality from the normal mode in that even if audio processing element 34A has highest priority in the normal mode, if audio processing element 34A does not have a request and audio processing element 34B does, WFU 36 services audio processing element 34B.

Once an audio processing element 34 successfully wins arbitration, the request can be broken down into two parts: retrieving the first waveform sample (denoted $Z_1$) and retrieving the second waveform sample (denoted $Z_2$). When a request comes in from a PE, fetch unit 56 adds the phase increment provided in the request to the current phase, resulting in a final phase with integer and fractional components. Depending on implementation, the sum may be saturated or allowed to roll over (i.e., circular buffering). If a win condition exists for the request, fetch unit 56 sends the fractional phase component to the audio processing element interface 50 for the requesting audio processing element 34. Using the integer phase component, fetch unit 56 calculates $Z_1$ in the following manner. If the waveform type is one-shot (i.e., not looped, as determined by the SVR control word), fetch unit 56 calculates $Z_1$ as equal to the integer phase component. If the waveform type is looped and there is no overshoot, fetch unit 56 calculates $Z_1$ as equal to the integer phase component. If the waveform type is looped and there is overshoot, fetch unit 56 calculates $Z_1$ as equal to the integer phase component minus the loop length.

Once fetch unit 56 has calculated $Z_1$, fetch unit 56 determines whether the waveform sample corresponding to $Z_1$ is currently cached in cache 58. If a cache hit occurs, fetch unit 56 retrieves the waveform sample from cache 58 and sends it to the audio processing element interface 50 of the requesting processing element. In the case of a cache miss, fetch unit 56 places an instruction to fetch the waveform sample from external memory into a queue. Retrieval module 57 checks the queue, and upon seeing an instruction in the queue to retrieve a cache line from external memory, retrieval module 57 begins a burst read of external memory and then replaces the current cache line with the contents retrieved during the burst read. A person of ordinary skill in the art will recognize that in the case of a cache miss (where the tag number was not of the same value as the tag number in the queue) retrieval module 57 may perform a burst read in another memory internal to WFU 36, before replacing the current cache line. The other memory may be a cache memory. As an example, cache 58 may be L1 cache and the other memory may be L2 cache. Thus, where retrieval module 57 performs the burst read may depend on the location of the memory (whether inside or outside of the WFU 36) and the caching strategy. Fetch unit 56 may be free to handle other requests from audio processing elements 34 while retrieval module 57 retrieves the cache line. Because waveform look-up values are read-only, fetch unit 56 may discard any existing cache line when retrieval module 57 retrieves a new cache line from external memory. In the case where the integer phase component overshoots and the waveform is one-shot, fetch unit 56 may send 0x0 as the sample to audio processing element interface 50. Once fetch unit 34 has sent the waveform sample corresponding to $Z_1$ to the requesting audio processing element interface 50, fetch unit 56 performs similar operations on waveform sample $Z_2$, where $Z_2$ is calculated based on $Z_1$.

For each request, fetch unit 56 may return at least two waveform samples, one per cycle. In the case of a stereo waveform, fetch unit 56 may return four waveform samples. In addition, fetch unit 56 may return the fractional phase if the implementation of the audio processing elements 34 requires it for interpolation. Audio processing element interface 50 pushes the waveform samples out to audio processing elements 34. Although illustrated as a single audio processing element interface 50, audio processing element interface 50 may in some cases include separate instances for each of the audio processing elements 34. Audio processing element interface 50 may use three sets of registers for each of the audio processing elements 34: a sixteen-bit register for storing the fractional phase, and two thirty-two-bit registers for storing the first and second samples, respectively. When an audio processing element 34 wins arbitration and is serviced by fetch unit 56, the fractional phase is registered by audio processing element interface 50. Audio processing element interface 50 may begin to push the data to the appropriate audio processing element 34 without waiting for all the data to be available, stalling only when the next required piece of data is not yet available.

In one example implementation, WFU 36 may be controlled by multiple finite state machines (FSMs) working together. For example, WFU 36 may include separate FSMs for each of audio processing element interface 50 (for managing migration of data from WFU 36 to audio processing elements 34), fetch unit 56 (for interfacing with cache 58), retrieval module 57 (for interfacing with external memory), synthesis parameter interface 54 (for interfacing with synthesis parameter RAM), and arbiter 52 (for arbitrating the incoming requests from audio processing elements and performing the calculations required to determine which samples to return). By using separate FSMs for fetching waveform samples and for managing transfer of data from WFU 36 to audio processing elements 34, arbiter 52 is freed up to service other requesting audio processing elements while audio processing element interface 50 is transferring a waveform sample. When fetch unit 56 determines that a requested waveform sample is not in cache 58, fetch unit 56 puts an instruction to receive a cache line from external memory in a queue and is then free to service the next request, while retrieval module 57 retrieves the cache line from external memory. When fetch unit 56 receives data from cache 58, an internal buffer, or external memory, rather than fetch unit 56 pushing the data to the requesting audio processing element, fetch unit 56 pushes the data to the corresponding audio processing element interface 50, thereby allowing fetch unit 56 to move on and service another request. This avoids handshaking cost, and any associated delay when the audio processing element does not immediately acknowledge the data.

Figure 4:
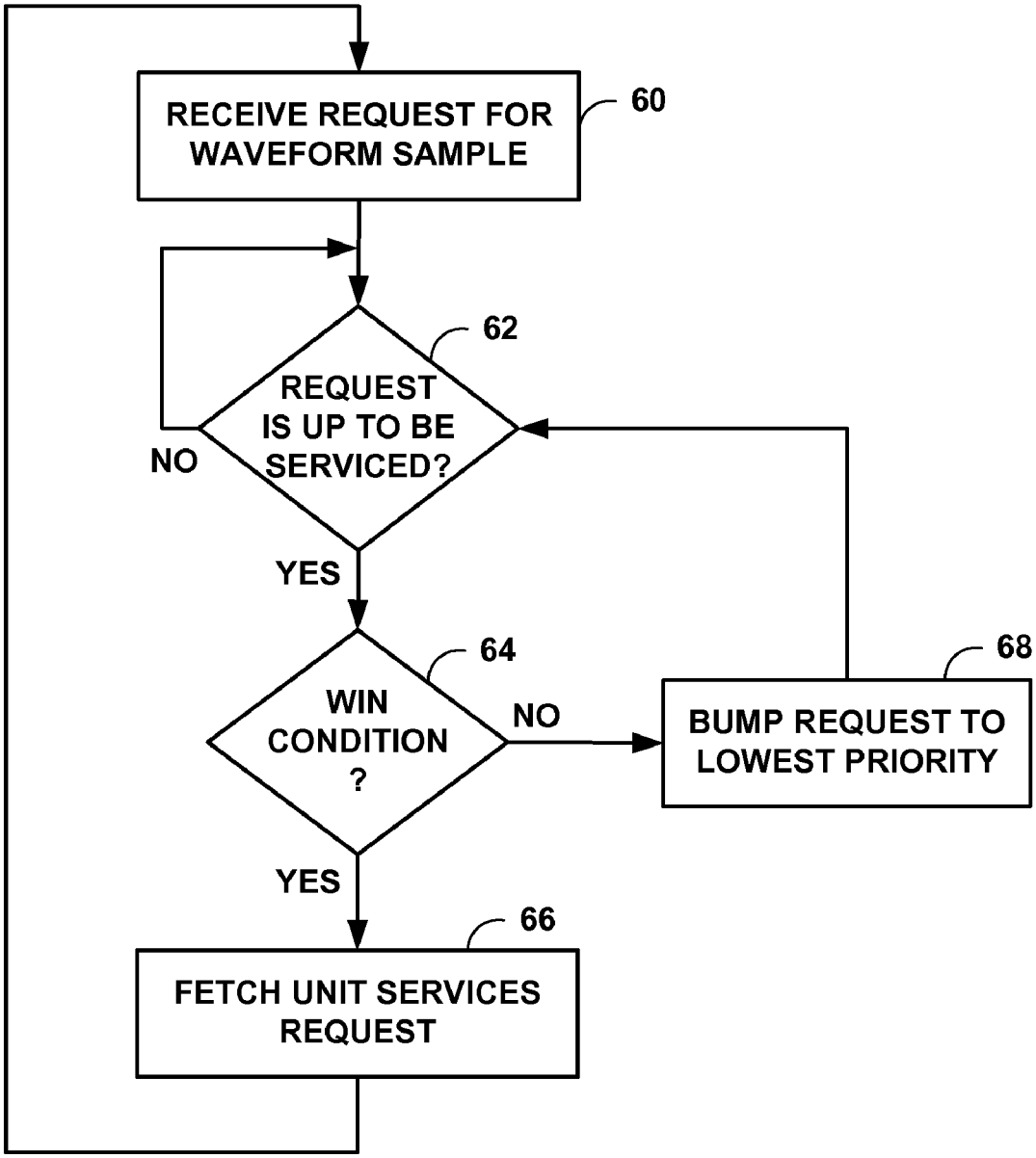
FIGS. 4-5 are flow diagrams illustrating exemplary techniques consistent with the teaching of this disclosure.

FIG. 4 is a flow diagram illustrating an exemplary technique consistent with the teaching of this disclosure. Arbiter 52 employs a modified round-robin arbitration scheme for arbitrating incoming requests for waveform samples from audio processing elements 34. WFU 36 assigns each of the audio processing elements 34 a default priority, e.g., with audio processing element 34A being the highest and audio processing element 34N being the lowest. When a request is waiting to be serviced (60), arbiter 52 uses a standard round-robin arbitration scheme to select the next audio processing element to be serviced. If the waiting request corresponds to the audio processing element that is up next to be serviced (62), the request is then checked for a win condition (64). For example, the request may be checked for whether the synthesis parameter data for the waveform sample is valid (i.e., locally buffered), and whether the corresponding audio processing element interface 50 is busy. All of these checks are combined to create a win condition. If a win condition occurs (YES branch of 64), fetch unit 56 services the audio processing element's request (66). Other embodiments may have different checks.

In the case where the synthesis parameters for the request are invalid and/or the audio processing element interface 50 is busy (NO branch of 64), arbiter 52 may bump the request to the lowest priority since no calculations can be made for the request (66). By employing this technique, WFU 36 services both requests resulting in a cache hit and requests resulting in a cache miss are serviced in a timely manner.

Figure 5:
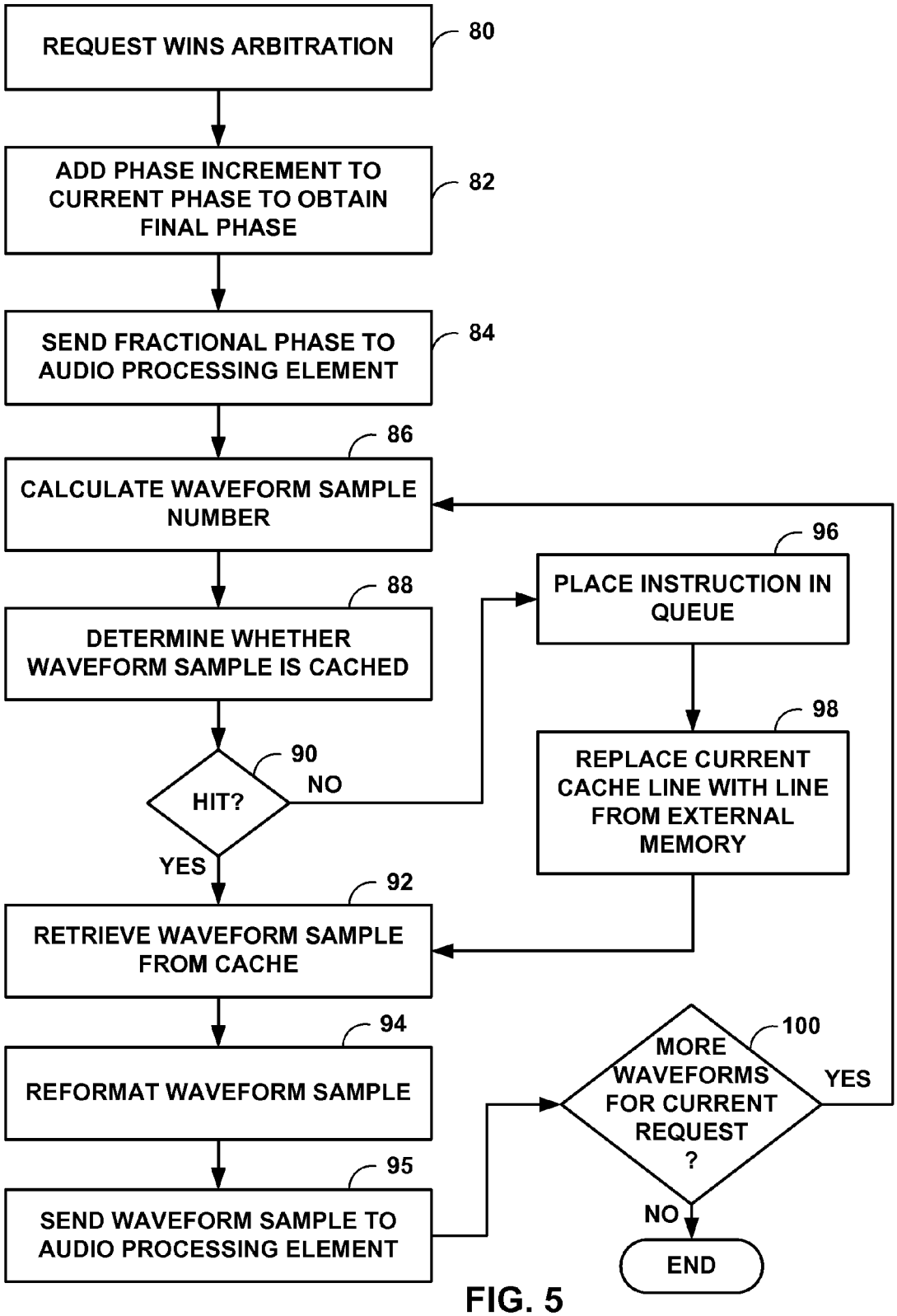

FIG. 5 is a flow diagram illustrating an exemplary technique consistent with the teaching of this disclosure. When a request wins arbitration (80), WFU 36 may service the request as follows. Fetch unit 56 adds the phase increment provided in the request to the current phase, resulting in a final phase with integer and fractional components (82). Fetch unit 56 then sends the fractional phase component to audio processing element interface 50 to be pushed to the requesting audio processing element 34 for use in interpolation (84). As mentioned above, WFU 36 may return multiple waveform samples to the requesting audio processing element, e.g., to account for phase shifting or for multiple channels. Fetch unit 56 calculates the waveform sample numbers of the waveform samples using the integer phase component (86). When the waveform type is one-shot (i.e., not looped, as determined by the SVR control word), fetch unit 56 calculates the first waveform ($Z_1$) as equal to the integer phase component. If the waveform type is looped and there is no overshoot, fetch unit 56 calculates $Z_1$ as equal to the integer phase component. If the waveform type is looped and there is overshoot, fetch unit 56 calculates $Z_1$ as equal to the integer phase component minus the loop length.

Once fetch unit 56 has calculated $Z_1$, fetch unit 56 determines whether the waveform sample corresponding to the waveform sample number $Z_1$ is currently cached in cache 58 (88). A cache hit may be determined by checking the waveform sample number against a tag identifying a currently cached waveform samples (i.e., a cache tag). This may be done by subtracting the cache tag value (i.e., a tag identifying the first sample currently stored in cache 58) from the waveform sample number of the requested waveform sample (i.e., $Z_1$ or $Z_2$). If the result is greater than zero and less than the number of samples per cache line, a cache hit has occurred. Otherwise, a cache miss has occurred. If a cache hit occurs, (YES branch of 90) fetch unit 56 retrieves the waveform sample from cache 58 (92) and sends the waveform sample to audio processing element interface 50, which outputs the waveform sample to the requesting processing element 34 (94). In the case of a cache miss (NO branch of 90), fetch unit 56 places an instruction to retrieve the waveform sample from external memory into a queue (96). When retrieval module 57 checks the queue and sees the request, retrieval module 57 begins a burst read to replace the current cache line with a line from external memory (98). Fetch unit 56 then fetches the waveform sample from cache 58 (92). Before sending the waveform sample, WFU 36 may in some cases reformat the waveform sample (94). For example, fetch unit 56 may convert the waveform samples to 16-bit stereo format, if the waveform samples are not already in 16-bit stereo format. In this manner, the audio processing elements 34 receive waveform samples from WFU 36 in a uniform format. Audio processing elements 34 can use the received waveform samples immediately without having to spend computation cycles on reformatting. WFU 36 sends the waveform sample to audio processing element interface 50 (95). After fetch unit 56 has sent the waveform sample corresponding to $Z_1$, fetch unit 56 performs similar operations on waveform sample $Z_2$, and any additional waveform samples required for servicing the request (100).

Various examples have been described in the disclosure. One or more aspects of the techniques described herein may be implemented in hardware, software, firmware, or combinations thereof. Any features described as modules or components may be implemented together in an integrated logic device or separately as discrete but interoperable logic devices. If implemented in software, one or more aspects of the techniques may be realized at least in part by a computer-readable medium comprising instructions that, when executed, performs one or more of the methods described above. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, one or more aspects of this disclosure may be directed to a circuit, such as an integrated circuit, chipset, ASIC, FPGA, logic, or various combinations thereof configured or adapted to perform one or more of the techniques described herein. The circuit may include both the processor and one or more hardware units, as described herein, in an integrated circuit or chipset.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

Various aspects and examples have been described. However, modifications can be made to the structure or techniques of this disclosure without departing from the scope of the following claims. For example, other types of devices could also implement the audio processing techniques described herein. These and other embodiments are within the scope of the following claims.

The invention claimed is:

1. A method comprising:

receiving a request for a waveform sample from an audio processing element; and servicing the request, wherein servicing the request includes:

calculating a waveform sample number for the requested waveform sample based on a phase increment contained in the request and an audio synthesis parameter control word associated with the requested waveform sample, wherein calculating the waveform sample number comprises calculating the waveform sample number according to a first method when the audio synthesis parameter control word indicates that the requested waveform sample is a looped waveform sample, and calculating the waveform sample number for the requested waveform sample according to a second method when the audio synthesis parameter control word indicates that the requested waveform sample is a non-looped waveform sample;

retrieving the requested waveform sample from a local cache using the waveform sample number; and sending the retrieved waveform sample to the requesting audio processing element.

2. The method of claim 1, further comprising:

determining a difference between a tag identifying a currently cached waveform sample and the waveform sample number; and fetching the requested waveform sample from an external memory to the local cache when the difference between the tag and the waveform sample number is greater than zero and less than a number of samples per cache line.

3. The method of claim 1, wherein sending the retrieved waveform sample to the requesting audio processing element comprises sending the retrieved waveform sample to an interface associated with the audio processing element, and wherein the interface transfers the retrieved waveform sample to the requesting audio processing element.

4. The method of claim 1, further comprising reformatting the retrieved waveform sample before sending the retrieved waveform sample to the requesting audio processing element.

5. The method of claim 4, wherein reformatting the retrieved waveform sample comprises converting the retrieved waveform sample to a 16-bit stereo format.

6. The method of claim 1, wherein receiving the request for the waveform sample comprises receiving a request for a musical instrument digital interface (MIDI) waveform sample, and wherein the audio synthesis parameter control word comprises a MIDI synthesis parameter control word.

7. A method comprising:

receiving a plurality of requests from a plurality of audio processing elements for waveform samples, and servicing the plurality of requests, wherein servicing the plurality of requests includes:

calculating a waveform sample number for a requested waveform sample based on a phase increment contained in a given request and an audio synthesis parameter control word associated with the requested waveform sample;

retrieving the requested waveform sample from a local cache using the waveform sample number; and sending the requested waveform sample to a requesting audio processing element, wherein servicing the plurality of requests comprises servicing the plurality of requests in an order according to an arbitration based on at least:

a round-robin arbitration in which a default priority level is assigned to each of the audio processing elements, and a determination of whether the waveform samples associated with the plurality of requests are already in the local cache.

8. The method of claim 7, wherein servicing the plurality of requests comprises servicing one of the plurality of requests when the round-robin arbitration indicates the requesting audio processing element is in turn to be serviced.

9. The method of claim 7, wherein the arbitration is further determined by whether an audio synthesis parameter associated with the requested waveform sample is locally buffered.

10. The method of claim 9, further comprising, when the audio synthesis parameter associated with the requested waveform is not locally buffered:

skipping a particular request associated with the requested waveform that is not locally buffered; and moving the particular request to a lowest priority level.

11. The method of claim 7, wherein the arbitration is further determined by whether an audio processing element interface associated with a particular request is busy, further comprising, when the audio processing element interface associated with the particular request is busy, moving the particular request to a lowest priority level.

12. A device comprising:

an audio processing element interface that receives a request for a waveform sample from an audio processing element;

a synthesis parameter interface that obtains an audio synthesis parameter control word associated with the requested waveform sample;

a local cache for storing the requested waveform sample; and a fetch unit that calculates a waveform sample number for the requested waveform sample based on a phase increment contained in the request and the audio synthesis parameter control word, and retrieves the requested waveform sample from the local cache using the waveform sample number, wherein in calculating the waveform sample number, the fetch unit calculates the waveform sample number according to a first method when the audio synthesis parameter control word indicates that the requested waveform sample is a looped waveform sample, and calculates the waveform sample number for the requested waveform sample according to a second method when the audio synthesis parameter control word indicates that the requested waveform sample is a non-looped waveform sample, and wherein the audio processing element interface sends the retrieved waveform sample to the requesting audio processing element.

13. The device of claim 12, wherein the fetch unit:

determines a difference between a tag identifying a currently cached waveform sample and the waveform sample number; and instructs a retrieval module to fetch the requested waveform sample from an external memory to the local cache when the difference between the tag and the waveform sample number is greater than zero and less than a number of samples per cache line.

14. The device of claim 12, wherein the fetch unit sends the retrieved waveform sample to the audio processing element interface, and wherein the audio processing element interface transfers the retrieved waveform sample to the requesting audio processing element.

15. The device of claim 12, wherein the fetch unit reformats the retrieved waveform sample before sending the retrieved waveform sample to the requesting audio processing element.

16. The device of claim 15, wherein the fetch unit reformats the retrieved waveform sample by converting the retrieved waveform sample to a 16-bit stereo format.

17. The device of claim 12, wherein the requested waveform sample comprises a musical instrument digital interface (MIDI) waveform sample, and wherein the audio synthesis parameter control word comprises a MIDI synthesis parameter control word.

18. A device comprising:

an audio processing element interface that receives a plurality of requests from a plurality of audio processing elements for waveform samples;

a synthesis parameter interface that obtains an audio synthesis parameter control word associated with a requested waveform sample;

a local cache for storing the requested waveform sample;

a fetch unit that calculates a waveform sample number for the requested waveform sample based on a phase increment contained in the request and the audio synthesis parameter control word, and retrieves the waveform sample from the local cache using the waveform sample number; and an arbiter that determines an order in which the plurality of requests are to be serviced by the fetch unit according to a round-robin arbitration in which a default priority level is assigned to each of the plurality of audio processing elements, wherein the audio processing element interface sends the retrieved waveform sample to a requesting audio processing element.

19. The device of claim 18, wherein the fetch unit services one of the plurality of requests when the arbiter indicates the requesting audio processing element is in turn to be serviced, and the requested waveform sample is already in the local cache.

20. The device of claim 18, wherein the arbiter determines the order in which the plurality of requests are to be serviced further based on whether an audio synthesis parameter associated with the requested waveform sample is locally buffered.

21. The device of claim 20, wherein when the audio synthesis parameter associated with the requested waveform is not locally buffered, the arbiter skips a particular request associated with the requested waveform that is not locally buffered and moves the particular request to a lowest priority level.

22. The device of claim 18, wherein the arbiter determines the order in which the plurality of requests are to be serviced further based on whether an audio processing element interface associated with a particular request is busy, and wherein the fetch unit moves the particular request to a lowest priority level when the audio processing element interface associated with the particular request is busy.

23. A device comprising:

an audio processing element interface that receives a plurality of requests from a plurality of audio processing elements for waveform samples;

a synthesis parameter interface that obtains an audio synthesis parameter control word associated with a requested waveform sample;

a local cache for storing the requested waveform sample; and a fetch unit that calculates a waveform sample number for the requested waveform sample based on a phase increment contained in the request and the audio synthesis parameter control word, and retrieves the waveform sample from the local cache using the waveform sample number, wherein the audio processing element interface sends the retrieved waveform sample to a requesting audio processing element, wherein the fetch unit places an instruction in a queue to retrieve the requested waveform sample from an external memory when the fetch unit determines that the requested waveform sample is not present within the local cache, and wherein the device further comprises a retrieval module that reads the instruction from the queue, and retrieves a cache line corresponding to the requested waveform sample from the external memory to the local cache according to the instruction.

24. A device comprising:

means for receiving a request for a waveform sample from an audio processing element;

means for obtaining an audio synthesis parameter control word associated with the requested waveform sample;

means for storing the requested waveform sample;

means for calculating a waveform sample number for the requested waveform sample based on a phase increment contained in the request and the audio synthesis parameter control word, wherein in calculating the waveform sample number, the means for calculating calculates the waveform sample number according to a first method when the audio synthesis parameter control word indicates that the requested waveform sample is a looped waveform sample, and calculates the waveform sample number for the requested waveform sample according to a second method when the audio synthesis parameter control word indicates that the requested waveform sample is a non-looped waveform sample;

means for retrieving the requested waveform sample from the means for storing using the waveform sample number; and means for sending the retrieved waveform sample to the requesting audio processing element.

25. The device of claim 24, further comprising:

means for determining a difference between a tag identifying a currently cached waveform sample and the waveform sample number; and means for fetching the requested waveform sample from an external memory to the means for storing when the difference between the tag and the waveform sample number is greater than zero and less than a number of samples per cache line.

26. The device of claim 24, further comprising means for reformatting the retrieved waveform sample by converting the retrieved waveform sample to a 16-bit stereo format.

27. The device of claim 24, wherein the requested waveform sample comprises a musical instrument digital interface (MIDI) waveform sample, and wherein the audio synthesis parameter control word comprises a MIDI synthesis parameter control word.

28. A device comprising:

means for receiving a plurality of requests for waveform samples from a plurality of audio processing elements;

means for obtaining an audio synthesis parameter control word associated with a requested waveform sample;

means for storing the requested waveform sample;

means for calculating a waveform sample number for the requested waveform sample based on a phase increment contained in the request and the audio synthesis parameter control word;

means for retrieving the requested waveform sample from the means for storing using the waveform sample number;

means for sending the retrieved waveform sample to a requesting audio processing element; and means for determining an order in which the plurality of requests are to be serviced according to a round-robin arbitration in which a default priority level is assigned to each of the requests.

29. A computer-readable medium comprising instructions that upon execution in one or more processors cause the one or more processors to:

receive a request for a waveform sample from an audio processing element; and service the request, wherein servicing the request includes:

calculating a waveform sample number for the requested waveform sample based on a phase increment contained in the request and an audio synthesis parameter control word associated with the requested waveform sample, wherein calculating the waveform sample number comprises calculating the waveform sample number according to a first method when the audio synthesis parameter control word indicates that the requested waveform sample is a looped waveform sample, and calculating the waveform sample number for the requested waveform sample according to a second method when the audio synthesis parameter control word indicates that the requested waveform sample is a non-looped waveform sample;

retrieving the requested waveform sample from a local cache using the waveform sample number; and sending the retrieved waveform sample to the requesting audio processing element.

30. The computer-readable medium of claim 29, further comprising instructions that upon execution cause the one or more processors to:

determine a difference between a tag identifying a currently cached waveform sample and the waveform sample number; and fetch the requested waveform sample from an external memory to the local cache when the difference between the tag and the waveform sample number is greater than zero and less than a number of samples per cache line.

31. The computer-readable medium of claim 29, wherein sending the retrieved waveform sample to the requesting audio processing element comprises sending the retrieved waveform sample to an interface associated with the audio processing element, and wherein the interface transfers the retrieved waveform sample to the requesting audio processing element.

32. The computer-readable medium of claim 29, further comprising instructions that cause the one or more processors to reformat the retrieved waveform sample before sending the retrieved waveform sample to the requesting audio processing element.

33. The computer-readable medium of claim 32, wherein reformatting the retrieved waveform sample comprises converting the retrieved waveform sample to a 16-bit stereo format.

34. The computer-readable medium of claim 29, wherein receiving the request for the waveform sample comprises receiving a request for a musical instrument digital interface (MIDI) waveform sample, and wherein the audio synthesis parameter control word comprises a MIDI synthesis parameter control word.

35. A computer-readable medium comprising instructions that upon execution in one or more processors cause the one or more processors to:

receive a plurality of requests from a plurality of audio processing elements for waveform samples, and service the plurality of requests, wherein servicing the plurality of requests includes:

calculating a waveform sample number for a requested waveform sample based on a phase increment contained in a given request and an audio synthesis parameter control word associated with the requested waveform sample;

retrieving the requested waveform sample from a local cache using the waveform sample number; and sending the requested waveform sample to a requesting audio processing element, wherein in servicing the plurality of requests, the instructions cause the one or more processors to service the plurality of requests in an order according to an arbitration based on at least:

a round-robin arbitration in which a default priority level is assigned to each of the audio processing elements, and a determination of whether the waveform samples associated with the plurality of requests are already in the local cache.

36. The computer-readable medium of claim 35, wherein servicing the plurality of requests comprises servicing one of the plurality of requests when the round-robin arbitration indicates the requesting audio processing element is in turn to be serviced.

37. The computer-readable medium of claim 35, wherein the arbitration is further determined by whether an audio synthesis parameter associated with the requested waveform sample is locally buffered.

38. The computer-readable medium of claim 37, further comprising instructions that upon execution cause the one or more processors to, when the audio synthesis parameter associated with the requested waveform is not locally buffered:

skip a particular request associated with the requested waveform that is not locally buffered; and move the particular request to a lowest priority level.

39. The computer-readable medium of claim 35, wherein the arbitration is further determined by whether an audio processing element interface associated with a particular request is busy, further comprising instructions that upon execution cause the one or more processors to, when the audio processing element interface associated with the particular request is busy, move the particular request to a lowest priority level.

40. A circuit adapted to:

receive a request for a waveform sample from an audio processing element; and service the request, wherein servicing the request includes:

calculating a waveform sample number for the requested waveform sample based on a phase increment contained in the request and an audio synthesis parameter control word associated with the requested waveform sample, wherein calculating the waveform sample number comprises calculating the waveform sample number according to a first method when the audio synthesis parameter control word indicates that the requested waveform sample is a looped waveform sample, and calculating the waveform sample number for the requested waveform sample according to a second method when the audio synthesis parameter control word indicates that the requested waveform sample is a non-looped waveform sample;

retrieving the requested waveform sample from a local cache using the waveform sample number; and sending the retrieved waveform sample to the requesting audio processing element.

41. The circuit of claim 40, wherein the circuit is adapted to:

determine a difference between a tag identifying a currently cached waveform sample and the waveform sample number; and fetch the requested waveform sample from an external memory to the local cache when the difference between the tag and the waveform sample number is greater than zero and less than a number of samples per cache line.

42. The circuit of claim 40, wherein sending the retrieved waveform sample to the requesting audio processing element comprises sending the retrieved waveform sample to an interface associated with the audio processing element, and wherein the interface transfers the retrieved waveform sample to the requesting audio processing element.

43. The circuit of claim 40, wherein the circuit is adapted to reformat the retrieved waveform sample before sending the retrieved waveform sample to the requesting audio processing element.

44. The circuit of claim 43, wherein reformatting the retrieved waveform sample comprises converting the retrieved waveform sample to a 16-bit stereo format.

45. The circuit of claim 40, wherein receiving the request for the waveform sample comprises receiving a request for a musical instrument digital interface (MIDI) waveform sample, and wherein the audio synthesis parameter control word comprises a MIDI synthesis parameter control word.

46. A circuit adapted to:

receive a plurality of requests from a plurality of audio processing elements for waveform samples, and service the plurality of requests, wherein servicing the plurality of requests includes:

calculating a waveform sample number for a requested waveform sample based on a phase increment contained in a given request and an audio synthesis parameter control word associated with the requested waveform sample;

retrieving the requested waveform sample from a local cache using the waveform sample number; and sending the requested waveform sample to a requesting audio processing element, wherein in servicing the plurality of requests, the circuit is adapted to service the plurality of requests in an order according to an arbitration based on at least:

a round-robin arbitration in which a default priority level is assigned to each of the audio processing elements, and a determination of whether the waveform samples associated with the plurality of requests are already in the local cache.

47. The circuit of claim 46, wherein servicing the plurality of requests comprises servicing one of the plurality of requests when the round-robin arbitration indicates the requesting audio processing element is in turn to be serviced.

48. The circuit of claim 46, wherein the arbitration is further determined by whether an audio synthesis parameter associated with the requested waveform sample is locally buffered.

49. The circuit of claim 48, wherein the circuit is adapted to, when the audio synthesis parameter associated with the requested waveform is not locally buffered:

skip a particular request associated with the requested waveform that is not locally buffered; and move the particular request to a lowest priority level.

50. The circuit of claim 46, wherein the arbitration is further determined by whether an audio processing element interface associated with a particular request is busy, the circuit being further adapted to, when the audio processing element interface associated with the particular request is busy, move the particular request to a lowest priority level.

* * * * *